US010755529B2

(12) United States Patent
Brown et al.

(10) Patent No.: US 10,755,529 B2
(45) Date of Patent: Aug. 25, 2020

(54) GAMING SYSTEM AND METHOD PROVIDING A VIDEO POKER GAME WITH MODIFIERS

(71) Applicant: IGT, Las Vegas, NV (US)

(72) Inventors: Bradford Brown, Sparks, NV (US); Wendy O'Steen-Wilson, Washoe Valley, NV (US); Benjamin R. Holsclaw, Sparks, NV (US); Gerardo Marquez, Reno, NV (US); James M. Cole, Reno, NV (US); David Howe, Reno, NV (US)

(73) Assignee: IGT, Las Vegas, NV (US)

( * ) Notice: Subject to any disclaimer, the term of this patent is extended or adjusted under 35 U.S.C. 154(b) by 447 days.

(21) Appl. No.: 14/495,079

(22) Filed: Sep. 24, 2014

(65) Prior Publication Data

US 2016/0086451 A1 Mar. 24, 2016

(51) Int. Cl.
*G07F 17/32* (2006.01)

(52) U.S. Cl.
CPC ..... *G07F 17/3293* (2013.01); *G07F 17/3244* (2013.01)

(58) Field of Classification Search
CPC ..... G07F 17/3293; G07F 17/3244
See application file for complete search history.

(56) References Cited

U.S. PATENT DOCUMENTS

| | | | |
|---|---|---|---|
| 1,527,929 | A | 2/1925 | Simons |
| 2,545,644 | A | 3/1951 | Benton et al. |
| 3,819,186 | A | 6/1974 | Hinterstocker |
| 4,258,838 | A | 3/1981 | Rockola et al. |
| 4,410,178 | A | 10/1983 | Partridge |
| 4,560,161 | A | 12/1985 | Hamano |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,756,531 | A | 7/1988 | DiRe et al. |
| 4,805,907 | A | 2/1989 | Haiwara |
| 4,836,553 | A | 6/1989 | Suttle et al. |
| 4,861,041 | A | 8/1989 | Jones et al. |
| 4,871,171 | A | 10/1989 | Rivero |
| 4,991,848 | A | 2/1991 | Greenwood et al. |
| 5,019,973 | A | 5/1991 | Wilcox et al. |
| 5,033,744 | A | 7/1991 | Bridgeman et al. |
| 5,092,598 | A | 3/1992 | Kamille |

(Continued)

FOREIGN PATENT DOCUMENTS

| | | |
|---|---|---|
| AU | 5032796 | 10/1997 |
| AU | 6355398 | 10/1998 |

(Continued)

*Primary Examiner* — Kang Hu
*Assistant Examiner* — Thomas H Henry
(74) *Attorney, Agent, or Firm* — Neal, Gerber & Eisenberg LLP

(57) ABSTRACT

Various embodiments of the present disclosure are directed to a gaming system and method providing a multi-hand video poker game in which the hands are displayed as an arrangement. One or more modifiers are applied to at least one row or column of the arrangement. All the hands are evaluated against one or more paytables and awards are determined. The awards for the hands that have applied modifiers are modified based on the respective modifier.

16 Claims, 11 Drawing Sheets

(56) References Cited

U.S. PATENT DOCUMENTS 5,098,107 A 3/1992 Boylan et al.
5,152,529 A 10/1992 Okada
5,167,413 A 12/1992 Fulton
5,178,390 A 1/1993 Okada
5,205,555 A 4/1993 Hamano
5,249,800 A 10/1993 Hilgendorf et al.
5,251,897 A 10/1993 Fulton
5,259,616 A 11/1993 Bergmann
5,288,077 A 2/1994 Jones
5,288,081 A 2/1994 Breeding
5,322,295 A 6/1994 Cabot et al.
5,332,219 A 7/1994 Marnell, II et al.
5,342,047 A 8/1994 Heidel et al.
5,342,049 A 8/1994 Wichinksy et al.
5,362,052 A 11/1994 Kubatsch
5,364,105 A 11/1994 Jones
5,374,067 A 12/1994 Jones
5,377,973 A 1/1995 Jones et al.
5,393,057 A 2/1995 Marnell, II
5,393,061 A 2/1995 Manship et al.
5,407,200 A 4/1995 Zalabak
5,411,257 A 5/1995 Fulton
5,431,407 A 7/1995 Hofberg et al.
5,431,408 A 7/1995 Adams
5,437,451 A 8/1995 Fulton
5,437,462 A 8/1995 Breeding
5,452,899 A 9/1995 Skratulia et al.
5,456,465 A 10/1995 Durham
5,490,670 A 2/1996 Hobert
5,494,287 A 2/1996 Manz
5,511,781 A 4/1996 Wood et al.
5,524,888 A 6/1996 Heidel
5,529,309 A 6/1996 Bartlett
5,531,440 A 7/1996 Dabrowski et al.
5,531,441 A 7/1996 Dabrowski et al.
5,531,448 A 7/1996 Moody
5,536,016 A 7/1996 Thompson
5,540,442 A 7/1996 Orselli et al.
5,542,669 A 8/1996 Charron et al.
5,560,603 A 10/1996 Seelig et al.
5,577,731 A 11/1996 Jones
5,584,485 A 12/1996 Jones et al.
5,607,162 A 3/1997 Boylan et al.
5,611,535 A 3/1997 Tiberio
5,626,341 A 5/1997 Jones et al.
5,636,838 A 6/1997 Caro
5,636,842 A 6/1997 Cabot et al.
5,647,798 A 7/1997 Falciglia
5,660,391 A 8/1997 Klasee
5,660,393 A 8/1997 Dreger
5,664,781 A 9/1997 Feola
5,711,525 A 1/1998 Breeding
5,732,948 A 3/1998 Yoseloff
5,732,950 A 3/1998 Moody
5,743,524 A 4/1998 Nannicola
5,755,440 A 5/1998 Sher
5,755,621 A 5/1998 Marks et al.
5,766,074 A 6/1998 Cannon et al.
5,769,716 A 6/1998 Saffari et al.
5,772,509 A 6/1998 Weiss
5,775,692 A 7/1998 Watts et al.
5,794,964 A 8/1998 Jones et al.
5,795,225 A 8/1998 Jones et al.
5,803,809 A 9/1998 Yoseloff
5,820,460 A 10/1998 Fulton
5,823,873 A 10/1998 Moody
5,833,536 A 11/1998 Davids et al.
5,833,537 A 11/1998 Barrie
5,848,932 A 12/1998 Adams
5,851,148 A 12/1998 Brune et al.
5,855,514 A 1/1999 Kamille
5,873,781 A 2/1999 Keane
5,873,823 A 2/1999 Eidelberg et al.
5,882,259 A 3/1999 Holmes, Jr. et al.
5,882,261 A 3/1999 Adams
5,885,157 A 3/1999 Harada et al.
5,890,962 A 4/1999 Takemoto
5,911,418 A 6/1999 Adams
5,919,088 A 7/1999 Weiss
5,927,714 A 7/1999 Kaplan
5,935,002 A 8/1999 Falciglia
5,951,397 A 9/1999 Dickinson
5,954,335 A 9/1999 Moody
5,957,774 A 9/1999 Holmes, Jr. et al.
5,964,463 A 10/1999 Moore, Jr.
5,967,894 A 10/1999 Kinoshita et al.
5,980,384 A 11/1999 Barrie
5,984,781 A 11/1999 Sunaga
5,996,997 A 12/1999 Kamille
5,997,400 A 12/1999 Seelig et al.
5,997,401 A 12/1999 Crawford
6,004,207 A 12/1999 Wilson, Jr. et al.
6,007,066 A 12/1999 Moody
6,015,346 A 1/2000 Bennett
6,019,369 A 2/2000 Nakagawa et al.
6,033,307 A 3/2000 Vancura
6,050,568 A 4/2000 Hachquet
6,059,289 A 5/2000 Vancura
6,062,979 A 5/2000 Inoue
6,062,980 A 5/2000 Luciano
6,089,976 A 7/2000 Schneider et al.
6,089,977 A 7/2000 Bennett
6,093,102 A 7/2000 Bennett
6,098,985 A 8/2000 Moody
6,102,798 A 8/2000 Bennett
6,117,009 A 9/2000 Yaseloff
6,120,031 A 9/2000 Adams
6,120,377 A 9/2000 McGinnis, Sr. et al.
6,120,378 A 9/2000 Moody et al.
6,126,541 A 10/2000 Fuchs
6,126,542 A 10/2000 Fier
6,135,885 A 10/2000 Lermusiaux
6,142,874 A 11/2000 Kodachi et al.
6,142,875 A 11/2000 Kodachi et al.
6,146,273 A 11/2000 Olsen
6,149,156 A 11/2000 Feola
6,149,521 A 11/2000 Sanduski
6,155,925 A 12/2000 Giobbi et al.
6,159,095 A 12/2000 Frohm et al.
6,159,096 A 12/2000 Yoseloff
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,176,781 B1 1/2001 Walker et al.
6,179,711 B1 1/2001 Yoseloff
6,190,254 B1 2/2001 Bennett
6,193,235 B1 2/2001 Vancura et al.
6,196,547 B1 3/2001 Pascal et al.
6,209,869 B1 4/2001 Matthews
6,210,279 B1 4/2001 Dickinson
6,213,876 B1 4/2001 Moore, Jr.
6,213,877 B1 4/2001 Walker et al.
6,217,022 B1 4/2001 Astaneha
6,224,483 B1 5/2001 Mayeroff
6,227,542 B1 5/2001 Cosmi
6,231,442 B1 5/2001 Mayeroff
6,231,445 B1 5/2001 Acres
6,238,288 B1 5/2001 Walker et al.
6,248,016 B1 6/2001 Walker et al.
6,251,013 B1 6/2001 Bennett
6,254,481 B1 7/2001 Jaffe
6,257,979 B1 7/2001 Walker et al.
6,261,177 B1 7/2001 Bennett
6,270,409 B1 8/2001 Shuster
6,270,412 B1 8/2001 Crawford et al.
6,290,600 B1 9/2001 Glasson
6,296,568 B1 10/2001 Tracy
6,302,790 B1 10/2001 Brossard
6,305,686 B1 10/2001 Perrie et al.
6,309,300 B1 10/2001 Glavich
6,311,976 B1 11/2001 Yoseloff et al.
6,311,978 B1 11/2001 Moody
6,315,664 B1 11/2001 Baerlocher et al.

(56) References Cited

U.S. PATENT DOCUMENTS

| | | | |
|---|---|---|---|
| 6,319,124 | B1 | 11/2001 | Baerlocher et al. |
| 6,322,078 | B1 | 11/2001 | Adams |
| 6,328,649 | B1 | 12/2001 | Randall et al. |
| 6,334,613 | B1 | 1/2002 | Yoseloff |
| 6,336,860 | B1 | 1/2002 | Webb |
| 6,340,158 | B2 | 1/2002 | Pierce et al. |
| 6,346,043 | B1 | 2/2002 | Colin et al. |
| 6,347,996 | B1 | 2/2002 | Gilmore et al. |
| 6,375,187 | B1 | 4/2002 | Baerlocher |
| 6,375,570 | B1 | 4/2002 | Poole |
| 6,398,218 | B1 | 6/2002 | Vancura |
| 6,398,220 | B1 | 6/2002 | Inoue |
| 6,406,023 | B1 | 6/2002 | Rowe |
| 6,406,369 | B1 | 6/2002 | Baerlocher et al. |
| 6,413,160 | B1 | 7/2002 | Vancura |
| 6,413,161 | B1 | 7/2002 | Baerlocher et al. |
| 6,416,408 | B2 | 7/2002 | Tracy et al. |
| 6,419,578 | B1 | 7/2002 | Moody et al. |
| 6,419,579 | B1 | 7/2002 | Bennett |
| 6,422,940 | B1 | 7/2002 | Walker et al. |
| 6,435,511 | B1 | 8/2002 | Vancura et al. |
| 6,439,993 | B1 | 8/2002 | O'Halloran |
| 6,439,995 | B1 | 8/2002 | Hughs-Baird et al. |
| 6,443,452 | B1 | 9/2002 | Brune |
| 6,454,266 | B1 | 9/2002 | Breeding et al. |
| 6,454,651 | B1 | 9/2002 | Yoseloff |
| 6,461,241 | B1 | 10/2002 | Webb et al. |
| 6,471,208 | B2 | 10/2002 | Yoseloff et al. |
| 6,474,645 | B2 | 11/2002 | Tarantino |
| 6,481,713 | B2 | 11/2002 | Perrie et al. |
| 6,491,584 | B2 | 12/2002 | Graham et al. |
| 6,494,454 | B2 | 12/2002 | Adams |
| 6,494,785 | B1 | 12/2002 | Gerrard et al. |
| 6,506,118 | B1 | 1/2003 | Baerlocher et al. |
| 6,514,141 | B1 | 2/2003 | Kaminkow et al. |
| 6,517,074 | B1 | 2/2003 | Moody et al. |
| 6,523,829 | B1 | 2/2003 | Walker et al. |
| 6,547,663 | B1 * | 4/2003 | Delott ..... G07F 17/32 273/138.1 |
| 6,561,898 | B2 | 5/2003 | Moody |
| 6,561,900 | B1 | 5/2003 | Baerlocher et al. |
| 6,561,904 | B2 | 5/2003 | Locke et al. |
| 6,565,433 | B1 | 5/2003 | Baerlocher et al. |
| 6,568,680 | B1 | 5/2003 | Moody et al. |
| 6,569,013 | B1 | 5/2003 | Taylor |
| 6,569,015 | B1 | 5/2003 | Baerlocher et al. |
| 6,575,830 | B2 | 6/2003 | Baerlocher et al. |
| 6,585,591 | B1 | 7/2003 | Baerlocher et al. |
| 6,595,854 | B2 | 7/2003 | Hughs-Baird et al. |
| 6,599,185 | B1 | 7/2003 | Kaminkow et al. |
| 6,599,192 | B1 | 7/2003 | Baerlocher et al. |
| 6,602,137 | B2 | 8/2003 | Kaminkow et al. |
| 6,604,740 | B1 | 8/2003 | Singer et al. |
| 6,607,437 | B2 | 8/2003 | Casey et al. |
| 6,609,974 | B2 | 8/2003 | Mead et al. |
| 6,612,927 | B1 | 9/2003 | Slomiany et al. |
| 6,632,141 | B2 | 10/2003 | Webb et al. |
| 6,638,164 | B2 | 10/2003 | Randall et al. |
| 6,652,377 | B1 | 11/2003 | Moody |
| 6,659,867 | B1 | 12/2003 | Kodachi et al. |
| 6,672,959 | B2 | 1/2004 | Moody et al. |
| 6,692,355 | B2 | 2/2004 | Baerlocher et al. |
| 6,699,122 | B1 | 3/2004 | Osawa |
| 6,719,630 | B1 | 4/2004 | Seelig et al. |
| 6,726,427 | B2 | 4/2004 | Jarvis et al. |
| 6,729,961 | B1 | 5/2004 | Millerschone |
| 6,731,313 | B1 | 5/2004 | Kaminkow |
| 6,780,109 | B2 | 8/2004 | Kaminkow |
| 6,786,818 | B1 | 9/2004 | Rothschild et al. |
| 6,805,344 | B2 | 10/2004 | Abe et al. |
| 6,851,349 | B2 | 2/2005 | Dohallow |
| 6,866,583 | B2 | 3/2005 | Glavich et al. |
| 6,877,745 | B1 | 4/2005 | Walker et al. |
| 6,899,620 | B2 | 5/2005 | Kaminkow et al. |
| 6,905,406 | B2 | 6/2005 | Kaminkow et al. |
| 6,905,408 | B2 | 6/2005 | Inoue |
| 6,913,532 | B2 | 7/2005 | Baerlocher et al. |
| 6,916,245 | B1 | 7/2005 | Vancura et al. |
| 6,921,335 | B2 | 7/2005 | Rodgers et al. |
| 6,935,950 | B2 | 8/2005 | Tarantino |
| 6,955,356 | B2 | 10/2005 | Moody |
| 6,955,600 | B2 | 10/2005 | Glavich et al. |
| 6,964,418 | B2 | 11/2005 | Moody |
| 6,971,954 | B2 | 12/2005 | Randall et al. |
| 6,981,635 | B1 | 1/2006 | Hughs-Baird et al. |
| 6,988,947 | B2 | 1/2006 | Baerlocher et al. |
| 6,991,538 | B2 | 1/2006 | Cannon |
| 6,994,624 | B2 | 2/2006 | Gold et al. |
| 7,014,559 | B1 | 3/2006 | Fong |
| 7,056,207 | B2 | 6/2006 | Walker et al. |
| 7,056,213 | B2 | 6/2006 | Ching et al. |
| 7,059,965 | B2 | 6/2006 | Jackson |
| 7,070,502 | B1 | 7/2006 | Bussick et al. |
| 7,070,503 | B2 | 7/2006 | Rudolph |
| 7,074,127 | B2 | 7/2006 | Cuddy et al. |
| 7,090,580 | B2 | 8/2006 | Rodgers et al. |
| 7,094,148 | B2 | 8/2006 | Baerlocher et al. |
| 7,115,033 | B1 | 10/2006 | Timperley |
| 7,137,628 | B2 | 11/2006 | Moody |
| 7,137,888 | B2 | 11/2006 | Glavich et al. |
| 7,156,397 | B2 | 1/2007 | Moody et al. |
| 7,156,734 | B1 | 1/2007 | Walker et al. |
| 7,169,042 | B2 | 1/2007 | Muir et al. |
| 7,192,345 | B2 | 3/2007 | Muir |
| 7,192,347 | B1 | 3/2007 | Marks et al. |
| 7,195,559 | B2 | 3/2007 | Gilmore et al. |
| 7,201,655 | B2 | 4/2007 | Walker et al. |
| 7,222,857 | B2 | 5/2007 | Moody |
| 7,222,858 | B2 | 5/2007 | Moody |
| 7,237,775 | B2 | 7/2007 | Thomas et al. |
| 7,247,092 | B2 | 7/2007 | Jarvis et al. |
| 7,250,001 | B2 | 7/2007 | Baerlocher et al. |
| 7,252,591 | B2 | 8/2007 | VanAsdale |
| 7,258,611 | B2 | 8/2007 | Bigelow, Jr. et al. |
| 7,275,989 | B2 | 10/2007 | Moody |
| 7,297,057 | B2 | 11/2007 | Gerrard et al. |
| 7,306,518 | B2 | 12/2007 | Hughs-Baird et al. |
| 7,331,863 | B2 | 2/2008 | Baerlocher |
| 7,331,866 | B2 | 2/2008 | Rodgers et al. |
| 7,338,370 | B2 | 3/2008 | Oles et al. |
| 7,354,344 | B2 | 4/2008 | Paulsen et al. |
| 7,371,168 | B2 | 5/2008 | Bilyeu et al. |
| 7,371,170 | B2 | 5/2008 | Cregan et al. |
| 7,381,134 | B2 | 6/2008 | Cuddy et al. |
| 7,396,279 | B2 | 7/2008 | Berman et al. |
| 7,399,225 | B2 | 7/2008 | Kaminkow |
| 7,402,103 | B2 | 7/2008 | Baerlocher |
| 7,404,762 | B2 | 7/2008 | Moody |
| 7,416,186 | B2 | 8/2008 | Walker et al. |
| 7,419,162 | B2 | 9/2008 | Lancaster et al. |
| 7,431,644 | B2 | 10/2008 | Moody |
| 7,488,247 | B2 | 2/2009 | Hughs-Baird et al. |
| 7,488,251 | B2 | 2/2009 | Kaminkow |
| 7,524,243 | B2 | 4/2009 | Bansemer et al. |
| 7,566,271 | B2 | 7/2009 | Hostetler et al. |
| 7,614,946 | B2 | 11/2009 | Nicely |
| 7,641,197 | B2 | 1/2010 | Jackson |
| 7,658,672 | B1 | 2/2010 | Wolf et al. |
| 7,666,083 | B2 | 2/2010 | Baerlocher et al. |
| 7,704,141 | B1 | 4/2010 | Marks et al. |
| 7,748,714 | B2 | 7/2010 | Nicely et al. |
| 7,749,059 | B2 | 7/2010 | Tarantino |
| 7,749,070 | B2 | 7/2010 | Baerlocher et al. |
| 7,771,274 | B2 | 8/2010 | Walker et al. |
| 7,785,188 | B2 | 8/2010 | Cannon |
| 7,803,041 | B2 | 9/2010 | Gold et al. |
| 7,803,043 | B2 | 9/2010 | Jackson |
| 7,815,500 | B2 | 10/2010 | Montross et al. |
| 7,819,740 | B2 | 10/2010 | Masci et al. |
| 7,837,545 | B2 | 11/2010 | Blair, Jr. et al. |
| 7,837,554 | B2 | 11/2010 | Kaminkow et al. |
| 7,857,693 | B1 | 12/2010 | Johnson et al. |
| 7,867,073 | B2 | 1/2011 | Walker et al. |
| 7,914,369 | B2 | 3/2011 | Walker et al. |

(56) References Cited

U.S. PATENT DOCUMENTS

| | | | |
|---|---|---|---|
| 7,918,724 | B2 | 4/2011 | Walker et al. |
| 7,922,575 | B2 | 4/2011 | Jankowski |
| 8,029,358 | B2 | 10/2011 | Bigelow, Jr. et al. |
| 8,062,119 | B2 | 11/2011 | Stern et al. |
| 8,083,578 | B2 | 12/2011 | Jackson |
| 8,092,290 | B2 | 1/2012 | Darby |
| 8,118,662 | B2 | 2/2012 | Caputo et al. |
| 8,137,174 | B2 | 3/2012 | Nicely et al. |
| 8,152,616 | B2 | 4/2012 | Moody |
| 8,177,620 | B2 | 5/2012 | Miles et al. |
| 8,235,780 | B2 | 8/2012 | Nicely |
| 8,235,781 | B2 | 8/2012 | Moody |
| 8,262,448 | B2 | 9/2012 | Nicely |
| 8,262,455 | B2 | 9/2012 | Caputo et al. |
| 8,272,940 | B2 | 9/2012 | Cuddy et al. |
| 8,277,305 | B2 | 10/2012 | Caputo et al. |
| 8,353,751 | B2 | 1/2013 | Bickley et al. |
| 8,360,848 | B2 | 1/2013 | Oles et al. |
| 8,408,984 | B2 | 4/2013 | Walker et al. |
| 8,419,525 | B2 | 4/2013 | Caputo et al. |
| 8,434,764 | B2 | 5/2013 | Walker et al. |
| 8,444,465 | B2 | 5/2013 | Macaulay |
| 8,449,362 | B2 | 5/2013 | Jackson |
| 8,460,094 | B2 | 6/2013 | Bigelow, Jr. et al. |
| 8,678,908 | B2 | 3/2014 | Nicely |
| 9,126,108 | B2 | 9/2015 | Moody |
| 9,142,095 | B2 | 9/2015 | Frank et al. |
| 2001/0005690 | A1 | 6/2001 | Boulton |
| 2002/0025844 | A1 | 2/2002 | Casey et al. |
| 2002/0045475 | A1 | 4/2002 | Glavich et al. |
| 2002/0072402 | A1 | 6/2002 | Baerlocher |
| 2002/0082074 | A1 | 6/2002 | Bennett |
| 2002/0142822 | A1 | 10/2002 | Baerlocher et al. |
| 2002/0151350 | A1 | 10/2002 | Baerlocher et al. |
| 2002/0155883 | A1 | 10/2002 | Baerlocher |
| 2002/0169017 | A1 | 11/2002 | Visoenik |
| 2002/0183109 | A1 | 12/2002 | McGahn et al. |
| 2003/0013514 | A1 | 1/2003 | Cregan et al. |
| 2003/0036422 | A1 | 2/2003 | Baerlocher et al. |
| 2003/0040355 | A1 | 2/2003 | Baerlocher |
| 2003/0045344 | A1 | 3/2003 | Webb et al. |
| 2003/0045348 | A1 | 3/2003 | Palmer et al. |
| 2003/0050110 | A1 | 3/2003 | Wichinsky |
| 2003/0064795 | A1 | 4/2003 | Baerlocher et al. |
| 2003/0078093 | A1 | 4/2003 | Simms et al. |
| 2003/0078096 | A1 | 4/2003 | Kaminkow et al. |
| 2003/0162578 | A1 | 8/2003 | Baerlocher et al. |
| 2003/0162584 | A1 | 8/2003 | Hughs-Baird et al. |
| 2003/0162585 | A1 | 8/2003 | Bigelow et al. |
| 2003/0203753 | A1 | 10/2003 | Muir et al. |
| 2003/0216163 | A1 | 11/2003 | Kaminkow et al. |
| 2003/0216165 | A1 | 11/2003 | Singer et al. |
| 2004/0033827 | A1 | 2/2004 | Gilmore et al. |
| 2004/0053672 | A1 | 3/2004 | Baerlocher |
| 2004/0053676 | A1 | 3/2004 | Rodgers |
| 2004/0152498 | A1 | 8/2004 | Kaminkow et al. |
| 2004/0195773 | A1 | 10/2004 | Masci et al. |
| 2004/0259625 | A1 | 12/2004 | Randall |
| 2005/0037836 | A1 | 2/2005 | Gilmore et al. |
| 2005/0054436 | A1 | 3/2005 | Frizzell et al. |
| 2005/0148384 | A1 | 7/2005 | Marks et al. |
| 2005/0170876 | A1 | 8/2005 | Masci et al. |
| 2005/0192081 | A1 | 9/2005 | Marks et al. |
| 2006/0030387 | A1 | 2/2006 | Jackson |
| 2006/0030392 | A1 | 2/2006 | Rodgers et al. |
| 2006/0063584 | A1 | 3/2006 | Brill et al. |
| 2006/0068875 | A1 | 3/2006 | Cregan et al. |
| 2006/0068881 | A1 | 3/2006 | Casey |
| 2006/0068883 | A1 | 3/2006 | Randall et al. |
| 2006/0068884 | A1 | 3/2006 | Baerlocher et al. |
| 2006/0073876 | A1 | 4/2006 | Cuddy |
| 2006/0084492 | A1 | 4/2006 | Baerlocher et al. |
| 2006/0084494 | A1 | 4/2006 | Belger et al. |
| 2006/0089191 | A1 | 4/2006 | Singer et al. |
| 2006/0121969 | A1 | 6/2006 | Marks et al. |
| 2006/0142077 | A1 | 6/2006 | Miles et al. |
| 2006/0194628 | A1 | 8/2006 | Novellie |
| 2006/0205469 | A1 | 9/2006 | Schultz et al. |
| 2006/0281525 | A1 | 12/2006 | Borissov |
| 2007/0060248 | A1 | 3/2007 | Rodgers et al. |
| 2007/0281778 | A1 | 12/2007 | Bigelow, Jr. et al. |
| 2008/0108409 | A1 | 5/2008 | Cole et al. |
| 2008/0108411 | A1 | 5/2008 | Jensen et al. |
| 2008/0111309 | A1 | 5/2008 | Nicely et al. |
| 2008/0113704 | A1 | 5/2008 | Jackson |
| 2008/0113735 | A1 | 5/2008 | Maya |
| 2008/0200237 | A1 | 8/2008 | Cuddy et al. |
| 2008/0311973 | A1 | 12/2008 | Jaffe |
| 2009/0111556 | A1* | 4/2009 | Moody ..... G07F 17/32 463/20 |
| 2009/0111559 | A1 | 4/2009 | Souza et al. |
| 2009/0124326 | A1 | 5/2009 | Caputo et al. |
| 2009/0291741 | A1 | 11/2009 | Schofield |
| 2010/0004051 | A1 | 1/2010 | Walker et al. |
| 2010/0197377 | A1 | 8/2010 | Aoki et al. |
| 2011/0014963 | A1 | 1/2011 | Walker et al. |
| 2012/0129589 | A1 | 5/2012 | Caputo et al. |
| 2012/0302317 | A1 | 11/2012 | Caputo et al. |
| 2012/0315980 | A1 | 12/2012 | Caputo et al. |
| 2013/0072282 | A1 | 3/2013 | Nicely |
| 2013/0196749 | A1 | 8/2013 | Caputo et al. |
| 2013/0273997 | A1* | 10/2013 | Stewart ..... G07F 17/3244 463/21 |

FOREIGN PATENT DOCUMENTS

| | | |
|---|---|---|
| AU | 711501 | 10/1999 |
| EP | 0 688 002 | 12/1995 |
| EP | 0 798 676 | 10/1997 |
| EP | 0 874 337 | 10/1998 |
| EP | 0 926 645 | 6/1999 |
| EP | 0 944 030 | 9/1999 |
| EP | 0 945 837 | 9/1999 |
| EP | 0 984 409 | 3/2000 |
| EP | 1 184 822 | 3/2002 |
| GB | 2 083 936 | 3/1982 |
| GB | 2 090 690 | 7/1982 |
| GB | 2 092 797 | 8/1982 |
| GB | 2 096 376 | 10/1982 |
| GB | 2 097 160 | 10/1982 |
| GB | 2 100 905 | 1/1983 |
| GB | 2 105 891 | 3/1983 |
| GB | 2 117 155 | 10/1983 |
| GB | 2 137 392 | 10/1984 |
| GB | 2 144 644 | 3/1985 |
| GB | 2 161 008 | 1/1986 |
| GB | 2 170 636 | 8/1986 |
| GB | 2 181 589 | 4/1987 |
| GB | 2 183 882 | 6/1987 |
| GB | 2 191 030 | 12/1987 |
| GB | 2 222 712 | 3/1990 |
| GB | 2 225 889 | 6/1990 |
| GB | 2 226 436 | 6/1990 |
| GB | 2 242 300 | 9/1991 |
| GB | 2 262 642 | 6/1993 |
| GB | 2 328 311 | 2/1999 |
| WO | WO 9732285 | 9/1997 |
| WO | WO 0012186 | 3/2000 |
| WO | WO 2007018680 | 2/2007 |

* cited by examiner

GAMING SYSTEM AND METHOD PROVIDING A VIDEO POKER GAME WITH MODIFIERS

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

In recent years, poker has become very popular. One of the most common variations of poker is Five Card Draw. In general, in Five Card Draw poker the player gets five cards dealt face up from a 52 card deck of playing cards. The player can discard none, one, a plurality or all of the five cards. Each discarded card is replaced with another card from the deck. This is called the draw. After the replacement, the cards are evaluated for winning combinations. For a five card poker game, there are ten general categories of hands, ranked from highest to lowest, as shown in Table 1 below.

TABLE 1

Ranking of Five Card Poker Hands by Category

| Rank | Name | Example |
|---|---|---|
| 1 | Royal Straight Flush | A♣K♣Q♣J♣10♣ |
| 2 | Straight Flush | K♣Q♣J♣10♣9♣ |
| 3 | Four of a Kind | J♣J♥ J♦ J♠3♣ |
| 4 | Full House | A♥ A♦ A♣6♦ 6♣ |
| 5 | Flush | A♣J♣8♣6♣2♣ |
| 6 | Straight | 8♦ 7♣6♠5♠4♣ |
| 7 | Three of a Kind | Q♠Q♥ Q♦ 6♦ 2♠ |
| 8 | Two Pair | 8♦ 8♥ 5♥ 5♣2♠ |
| 9 | One Pair | K♦ K♠8♣7♣2♥ |
| 10 | High Card | A♥ 10♣7♦ 5♠3♠ |

Within each category, hands are ranked according to the rank of individual cards, with an Ace being the highest card and a two being the lowest card. There is no difference in rank between the four suits of cards. All hands can be ranked in a linear ranking from highest to lowest. Because suits are all of the same value, however, there are multiple hands that have identical rankings. For example, there are four equivalent hands for each type of straight flush, four of a kind, or flush. There are over a hundred equivalent hands for each two pair variation, and there are over 1,000 equivalent hands for each type of no-pair hand.

Numerous variations of poker exist, including Five Card Draw as mentioned above, Three Card Poker, Five Card Stud, Seven Card Stud, Hold'em (also called Texas Hold'em), Omaha (also called Omaha Hold'em), and Pai-Gow Poker. The variations in these games generally differ in the manner in which cards are dealt and in the manner and frequency in which bets are placed. Various criteria may also be used to determine the winning hand, including highest ranking hand, lowest ranking hand (Low-Ball), and where the high and low hands each win half of the pot (High-Low).

Another popular variant of Five Card Draw Poker is multi-hand poker. In this variation, the player plays three or more poker hands simultaneously. The player is dealt a first hand of five cards face-up from a first deck of cards. The player decides to hold none, some, or all of the dealt cards. The held cards are then replicated to the other hands. The first hand is then completed from the first deck of cards. The other hands are completed from their own separate deck of cards. Each of the hands is individually evaluated against a paytable, such as the one shown in Table 1. Numerous variations of multi-hand poker also exist, which enable the player to play a different number of hands simultaneously, such as up to a 100 hands.

Although these variations add excitement to the standard draw poker game play, there is a need to provide additional variations in multi-hand video poker games that provide additional win opportunities.

SUMMARY

Various embodiments of the present disclosure are directed to a gaming system and method providing a multi-hand video poker game with additional win opportunities.

In certain embodiments, the gaming system is configured to receive a bet from a player and initiate a play of the video poker game. The gaming system displays a first player hand and a second quantity of player hands. The second quantity of player hands is displayed in an arrangement, having at least one row and at least one column. The gaming system determines a quantity of modifiers to be provided for the play of the video poker game. The gaming system also determines each of the modifiers to be provided. For each modifier from the quantity of modifiers, the gaming system enables the player to make one or more inputs to apply that provided modifier to one of one of the rows and one of the columns of the arrangement of player hands. After the player applies the one or more modifiers, the gaming system displays cards in the first player hand. The player can hold zero, some or all of the cards in the first player hand. The held cards are replicated across the second quantity of player hands. The gaming system completes the first player hand by replacing the cards that are not held, if any, with others cards. Each of the second quantity of player hands is completed from separate individual decks of cards with the held and discarded cards removed. The gaming system then evaluates each of the player hands against a paytable to determine an award, if any. Winning hands in the player selected row or column are modified based on the provided modifier, if any, for that player selected row or column. The gaming system modifies the awards for winning hands, if any, based on the modifiers that are applied to the winning hands and displays the award. In certain alternative embodiments, the gaming system determines the row or column to which the selected modifiers are applied.

It should thus be appreciated that the gaming system and method of the present disclosure that provide new and different video poker games, thereby increasing player enjoyment, entertainment, and excitement.

Additional features and advantages are described herein, and will be apparent from, the following Detailed Description and the Figures.

DETAILED DESCRIPTION

Video Poker Game

Figure 1:
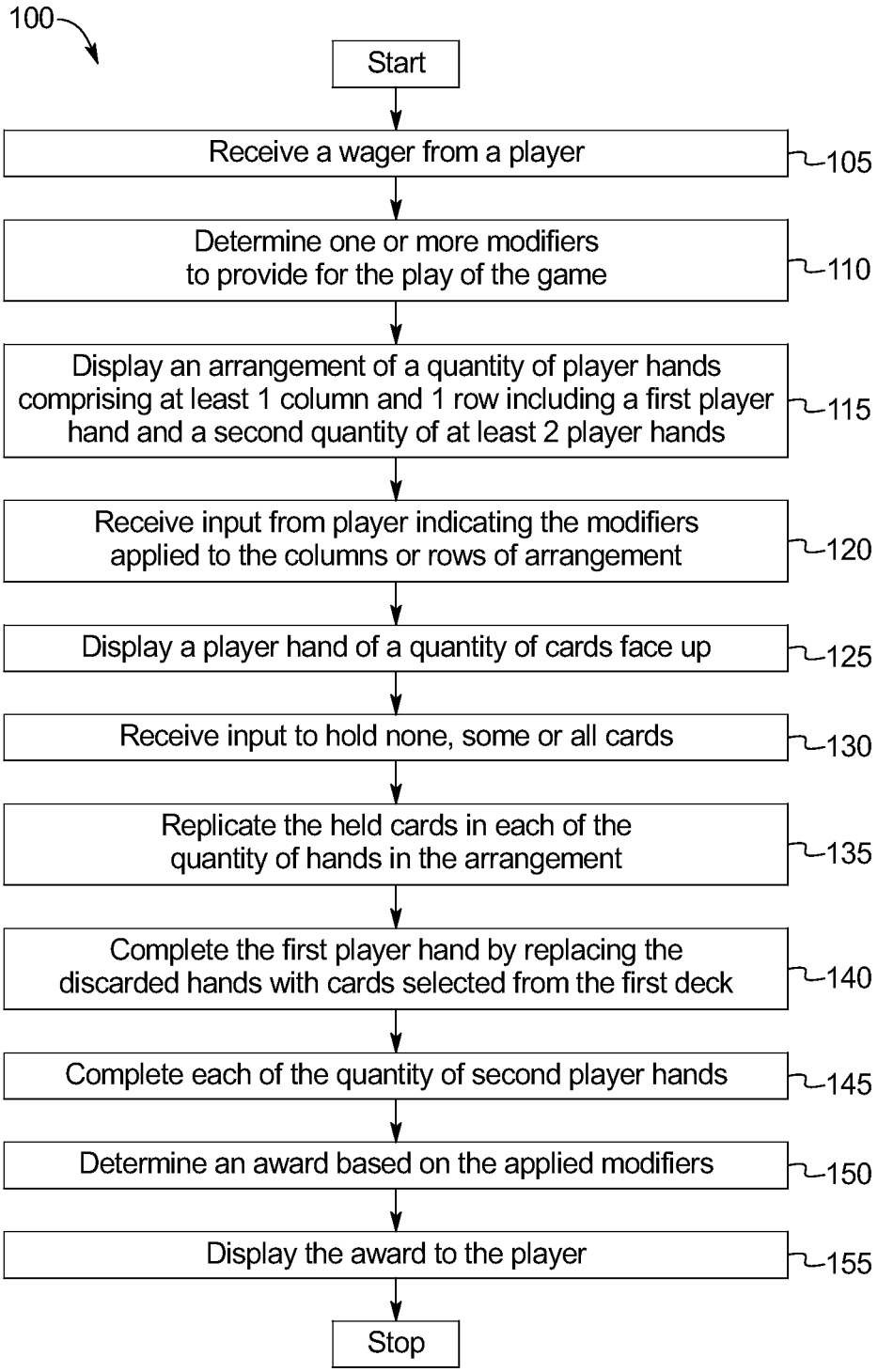
FIG. 1 is a flowchart illustrating a method of operating an example embodiment of a gaming system of the present disclosure.

In certain embodiments, the gaming system is configured to receive a bet from a player and initiate a play of the video poker game. The gaming system displays a first player hand and a second quantity of player hands. The second quantity of player hands is displayed in an arrangement, having at least one row and at least one column. The gaming system determines a quantity of modifiers to be provided for the play of the video poker game. The gaming system also determines each of the modifiers to be provided. For each modifier from the quantity of modifiers, the gaming system enables the player to make one or more inputs to apply the provided modifier to one of one of the rows and one of the columns of the arrangement of player hands. After the player applies the one or more modifiers, the gaming system displays cards in the first player hand. The player can hold zero, some or all of the cards in the first player hand. The held cards are replicated across the second quantity of player hands. The gaming system completes the first player hand by replacing the cards that are not held, if any, with others cards. Each of the second quantity of player hands is completed from separate individual decks of cards with the held and discarded cards removed. The gaming system then evaluates each of the player hands against a paytable to determine an award, if any. Winning hands in the player selected row or column are modifier based on the provided modifier, if any, for that player selected row or column. The gaming system modifies the awards for winning hands, if any, based on the modifiers that are applied to the winning hands and displays the award.

The modifier may be any suitable modifier. In various embodiments, the modifier includes turning certain cards to wild cards, providing a multiplier, providing a bonus game, providing a feature for the play of the video poker game, or unlocking game features for the current or future play of the video poker game.

In certain embodiments, for the play of the video poker game, the gaming system first displays the playing cards in the first player hand and then subsequently provides one or more modifiers. In other words, the player can view the cards in the player hand prior to determining to which row or column to apply the modifier. This adds additional player strategy for the play of the game.

In certain embodiments, instead of the player, the gaming system determines the row or column to which each of the selected modifiers is applied. The gaming system makes the determination randomly, based on a weighted table, based on player selections or preferences inputted by the player prior to the play of the game, or any other suitable way.

While the video poker game of the present disclosure is employed as a primary game in the embodiments described below, it should be appreciated that the video poker game may additionally or alternatively be employed as or in association with a bonus game or a secondary game. Moreover, while any credit balances, any wagers, and any awards are displayed as an amount of monetary credits or currency in the embodiments described below, one or more of such credit balances, such wagers, and such awards may be for non-monetary credits, promotional credits, and/or player tracking points or credits.

In various embodiments, the gaming system determines one or more modifiers after the player places a wager and prior to display of any cards to the player. The determined one or more modifiers are displayed to the player after the player selects the row or column to which each of the determined one or more modifiers will be applied. For example, the gaming system may determine that the player is to be provided two modifiers, one being a 5× multiplier, and the other being a Deuces Wild modifier. However, the gaming system does not reveal the selected modifiers to the player until the player selects the row(s) and/or the column (s) to which the modifiers will apply. In other words, the gaming system receives input from the player, indicating the row or column to which the player chooses to apply each of the determined modifiers, and then the gaming system reveals the modifiers to the player.

In certain embodiments, where the quantity of provided modifiers exceeds one, the gaming system requires the player to apply at least one modifier to one row and at least one modifier to one column. In certain embodiments, the gaming system enables the player to apply more than one modifier to a single row or column.

FIG. 1 is a flowchart illustrating a method of operating an example embodiment of a gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

The gaming system is configured to begin the play of a multi-hand video poker game upon receiving a wager for the play of the game from a player, as indicated by block 105. The gaming system then determines one or more modifiers to provide for the play of the video poker game, as indicated by block 110. The one or more modifiers are displayed to the player. The gaming system displays an arrangement of a quantity of player hands including a first player hand and a second quantity of player hands for the play of the video poker game, as indicated by block 115. The arrangement is displayed such that the arrangement from the quantity of player hands has at least one column and one row. For example, in certain embodiments, the arrangement is shown as a grid of player hands with n rows and m columns, where $n>0$ and $m>0$.

As indicated by block 120, the gaming system then enables the player to determine one of one of the rows and one of the columns of the arrangement to which to apply each of the determined one or more modifiers. After receiving at least one input from the player indicative of the at least one row or at least one column to which to apply the determined modifiers, the gaming system then displays a quantity of cards face up to the player in the first player hand from a first deck of playing cards, as indicated by block 125. In various embodiments, the quantity of cards is five. The gaming system then receives at least one input from the player, indicative of zero, some, or all of the quantity of cards provided that the player wishes to hold, as indicated by block 130. The cards that are not held by the player are discarded.

The gaming system replicates the cards that are held by the player in the first player hand to each of the second quantity of player hands, as indicated by block 135. The gaming system then completes the first player hand by replacing the cards that are not held, if any, with cards selected from the first deck of playing cards, as indicated by block 140. For each player hand, the gaming system randomly selects the replacement cards from the remaining cards in the virtual deck of cards for that player hand. The gaming system does this by first discarding any cards that were dealt in the player hand from the virtual deck and then selecting replacement cards. For the first player hand, the initially dealt quantity of cards is removed and for each of the second quantity of player hands, the replicated cards (or the held cards) are removed. The selection of replacement cards can be random or determined by a central server. In certain embodiments, the gaming system includes the discarded cards back in the virtual deck before selecting the replacement cards. The gaming system also completes each of the second quantity of player hands, as indicated by block 145. For each player hand in the second quantity of player hands, the gaming system provides additional playing cards, if any, from a separate deck of playing cards. Each of the decks of cards has the same quantity of cards in one embodiment. In certain embodiments, the first player hands is selected from a first deck and each of the player hands in the second quantity is selected from identical second decks of cards, such that the quantity of cards in the first deck and the second deck is different.

At block 150, the gaming system determines an award, if any, based on each of the player hands and the applied modifiers. The gaming system uses one or more paytables to determine an award for each hand. The gaming system then uses any modifiers applied to the selected player hands in the second quantity of player hands to modify the awards for those player hands. The award for each of the player hands is then combined to determine a total award for the player. This award is then displayed to the player, as indicated by block 155. This concludes the play of the game, as indicated by block 160, and the gaming system then enables the player to place another wager, to begin another round of play.

In certain embodiments, the gaming system first applies the modifiers to the selected hand prior to determining the award for each hand. For example, if the determined modifier is a deuces wild which turns all cards in the applied player hand having a rank of two to wild, that is, substituting them for any other card in the deck to achieve the highest possible payout, the wild modifier is applied prior to determining the payout for that hand.

Figure 2A:
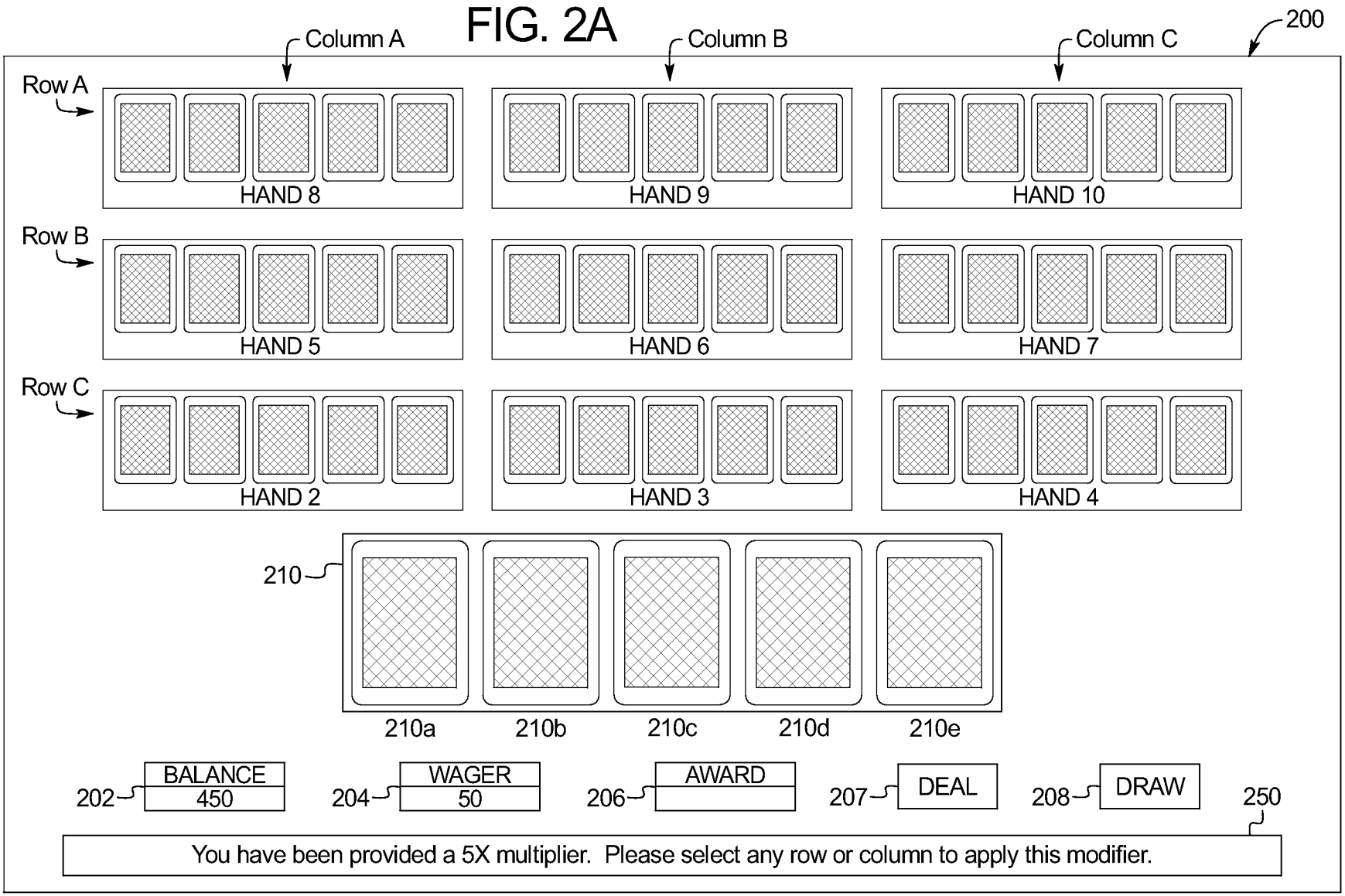
FIGS. 2A, 2B, 2C, 2D and 2E illustrate screens of an example embodiment of a gaming system of the present disclosure.

FIGS. 2A, 2B, 2C, 2D, and 2E illustrate screens of the gaming system of the present disclosure operating an example embodiment of a gaming system of the present disclosure. As seen in FIG. 2A, Screen 200 shows a first player hand which includes five player cards, 210*a*, 210*b*, 210*c*, 210*d* and 210*e*. The screen also includes display areas 202, 204, and 206. Display area 202 shows the current credit balance. Display area 204 shows the amount of credits wagered on the current play of the game. Display area 206 shows an award amount, if any, to be provided for the play of the game, after the completion of the game. Screen 200 also includes player input areas 207 and 208. Input area 207 enables the player to begin a round of play by making a wager. Input area 208 enables the player to draw cards to replace the cards not held by the player. Screen 200 also shows an arrangement of a second quantity of player hands, shown as Hand 2 through Hand 10, arranged in 3 rows and 3 columns. Screen 200 further includes an information display area 250, which informs the player about various stages of play in a round of game play. In accordance with the embodiment described in FIG. 1, after the player makes a wager, the gaming system determines one or more modifiers to provide for the play of the game. The determination is random, predetermined, based on the wager made, based on one or more other characteristics associated with the player, or otherwise suitably determined. Here, the gaming system has randomly determined to provide a 5× multiplier as the modifier to the player. Gaming system informs the player that the player may apply the 5× multiplier to any single row or single column, through the information display area 250.

The gaming system enables the player to apply the modifier by selecting either a single row from the three rows: Row A, Row B, and Row C, or selecting a single column from the three columns: Column A, Column B, and Column C. The gaming system receives player inputs in one or more ways from the player, such as by way of the playing activating a touch screen input device, the playing using physical buttons on the gaming system that correspond to each of the available choices, or other similar input peripherals such as a mouse or keyboard. After the gaming system receives the required inputs from the player indicative of one or more rows and or columns to which the provided modifiers are to be applied, the gaming system proceeds with the play of the game. It should be appreciated that in this example embodiment, the quantity of rows and columns is equal. However, in certain alternative embodiments, the quantity of rows and columns do not need to be equal.

Figure 2B:
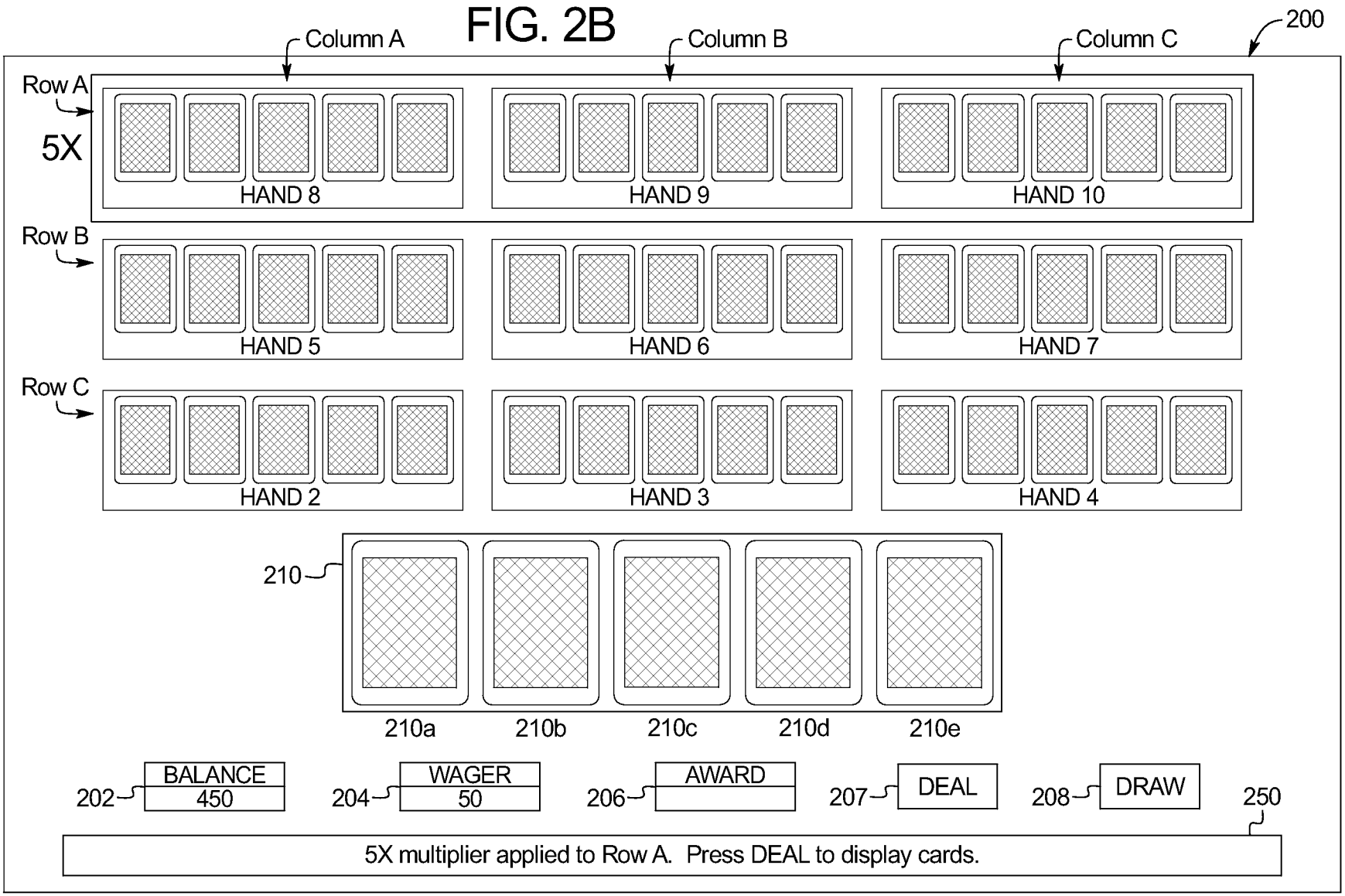

FIG. 2B illustrates the screen of the gaming system depicting play of the game. Screen 200 shows that the player has applied the 5× multiplier to Row A. At the stage, the gaming system then prompts the player to begin play by pressing the deal button 207.

Figure 2C:
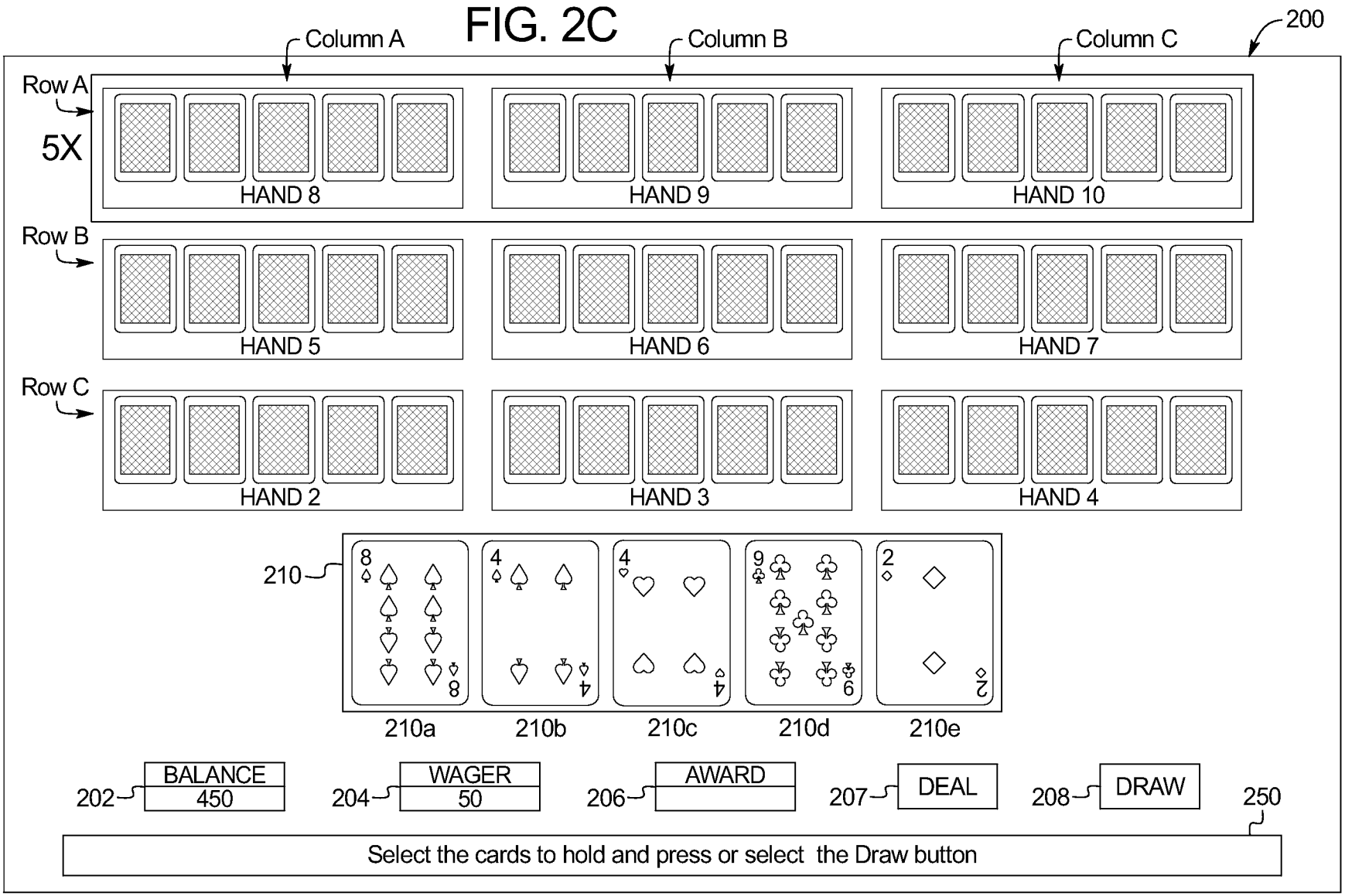

FIG. 2C illustrates the screen of the gaming system depicting play of the game. The gaming system provides the player with a quantity of five face up cards in the first player hand 210. The gaming system then enables the player to hold zero, some or all of the five face up cards in the player hand 210. The gaming system uses one or more input peripherals such as a touch screen input device, physical buttons, keyboard, mouse, or other peripheral input devices to enable the player to indicate which of the five cards to hold. After the player indicates to the gaming system which of the five cards to hold, the player also makes an input to the gaming system indicating that play should proceed. This is usually by way of a 'Draw' button such as Button 208. In this depicted example, the player holds cards 210*b* and 210*c*.

Figure 2D:
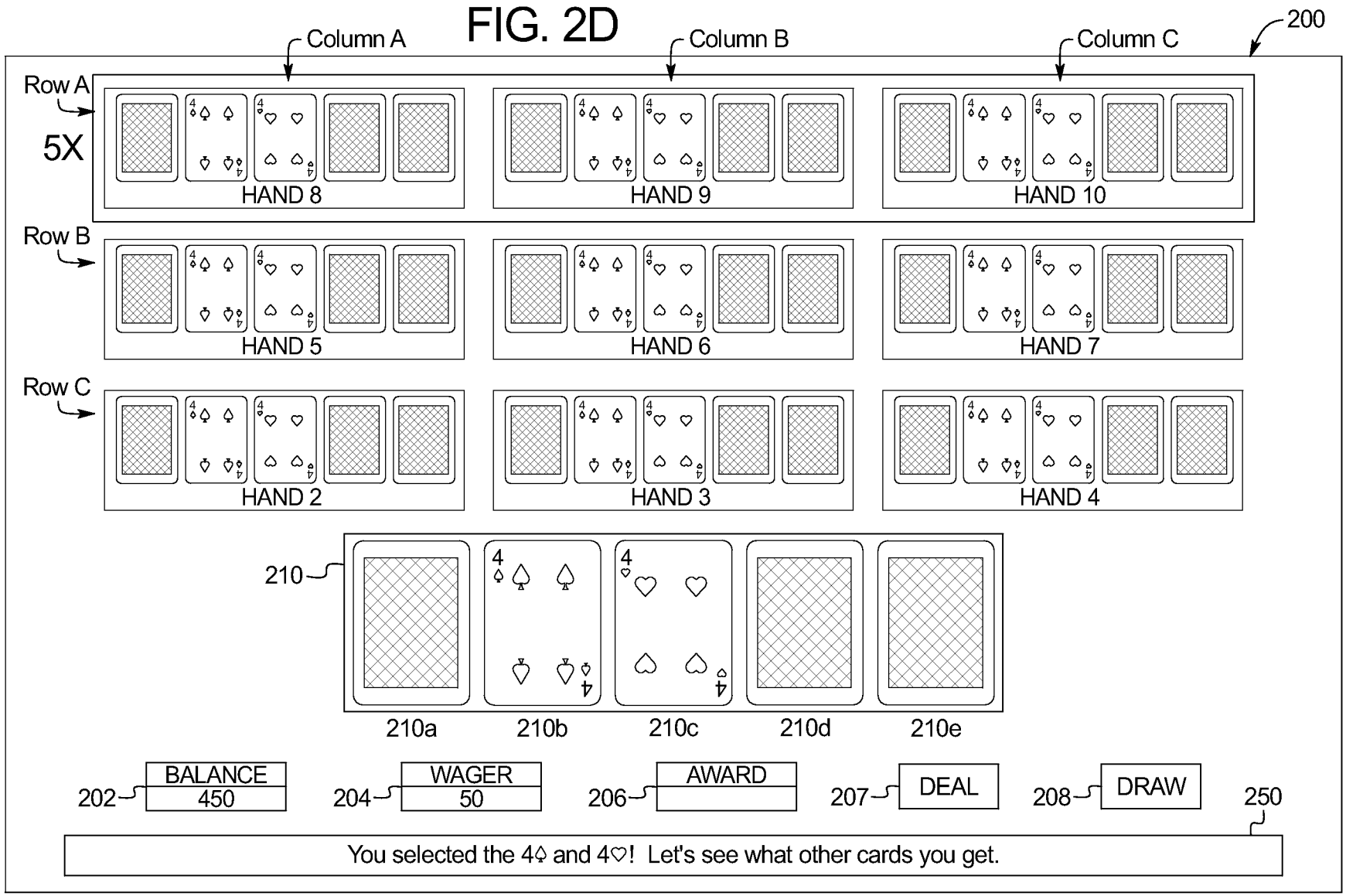

FIG. 2D illustrates the screen of the gaming system after the gaming system receives player input indicative of zero, some, or all of the five cards that are to be held. Screen 200 depicts that the player has indicated to hold cards 210*b* and 210*c*. The gaming system replicates the held cards 210*b* and 210*c* across player hand 2 through player hand 10. The gaming system also prompts the player through information display area 250 that the gaming system is holding cards 210*b* and 210*c* and that the gaming system will provide three replacement cards in place of the cards not held by the player, for each of player hand 1 through player hand 10.

Figure 2E:
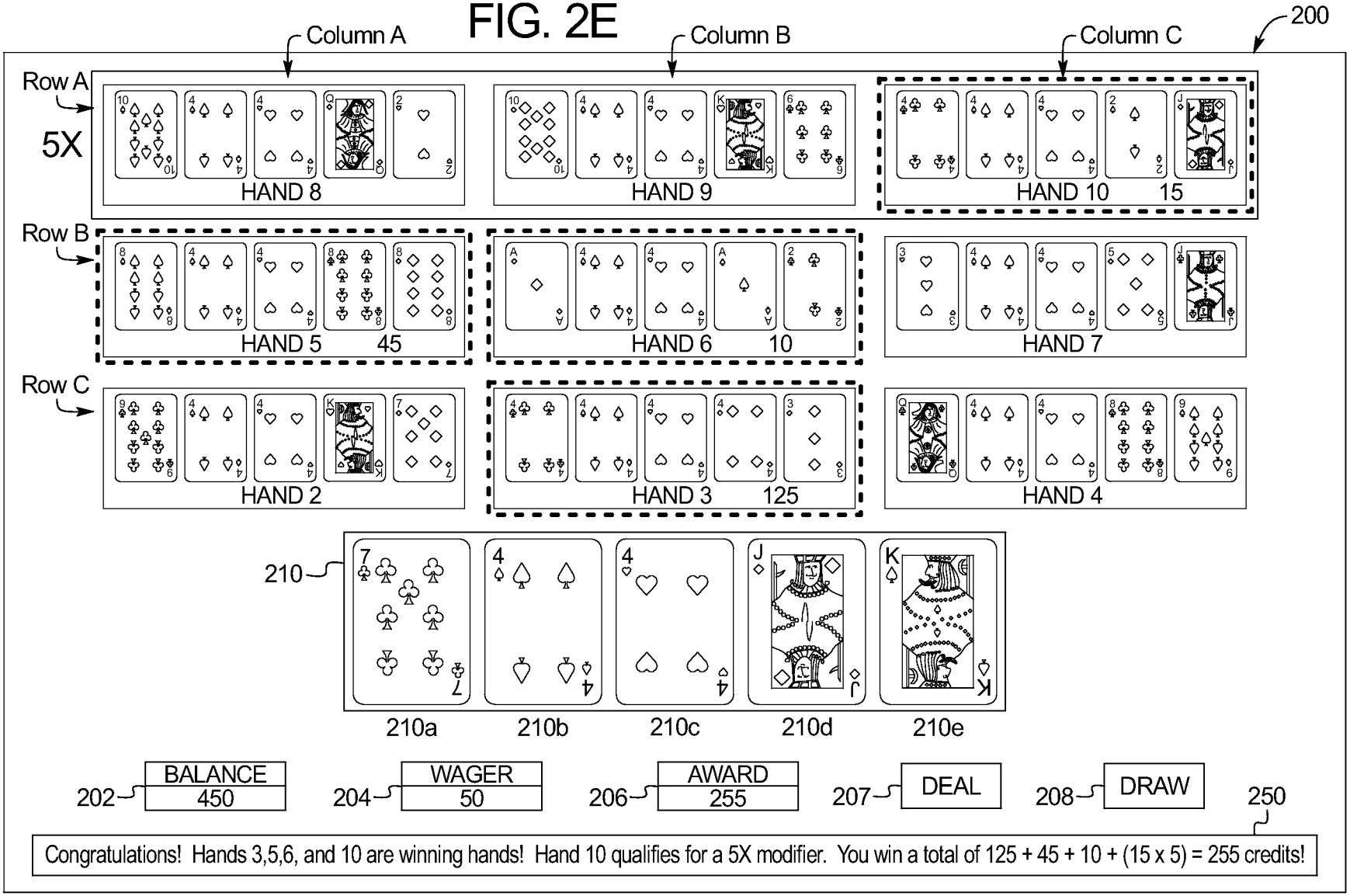

The gaming system then proceeds to complete the play of the game as depicted by FIG. 2E. The gaming system completes each player hand by providing the three cards needed in each hand. The cards provided for each hand are provided from a separate deck of playing cards for each hand. After all of the player hands are completed, the gaming system determines an award, if any, for the player. To determine the award, the gaming system compares the outcome of each player hand against one or more paytables. The gaming system also applies the modifier to the selected player hands. In this example, the modifiers are applied to player hands in Row A, i.e., Hand 8, Hand 9, and Hand 10. The modifier is a 5× multiplier. The gaming system determines the award for each of these hands and multiplies it by 5. In this case, only Hand 10 is a winning hand, i.e., three of a kind and the payout as indicated by the paytable is multiplied by 5. This is then added to the payouts for each of the other winning hands, i.e., in this example Hand 3, Hand 5, and Hand 6. The total award of 255 credits is then displayed to the player. This is added to the credit balance on the gaming system and the player can then begin another round of play or terminate the gaming session.

In various embodiments, the gaming system provides at least two modifiers for the play of the game. In various embodiments, the gaming system randomly determines the quantity of modifiers to be provided for the play of the game and then randomly determines each of the modifiers from the quantity of modifiers to be provided. In certain embodiments, the quantity of modifiers to be provided is based on the amount of wager placed by the player.

In certain embodiments where the gaming system provides at least two modifiers, the player is enabled to apply each of the modifiers to one row or one column but not to two rows or to two columns. In certain of these embodiments, the player is enabled to apply at least two modifiers to the same row or column.

In certain embodiments, the player is enabled to split a given modifier and apply it across at least two rows or two columns or a combination of one row and one column. For example, if the player is provided a 5× multiplier, the player is enabled to split it in to (a) a 3× and a 2× multiplier, or (b) keep it as a 5× multiplier. The player can then apply these multipliers, to more than one row or one column if the player decides to split the multiplier. In various embodiments, the player is enabled to split at least one modifier into three or more modifiers. For example, a 7× multiplier can be split in to 3× multiplier, 2× multiplier and 2× multiplier In various embodiments, the gaming system includes player hand 1 in the arrangement of hands such that player hand 1 is part of at least one column and one row to which the player can apply modifiers. In certain embodiments, player hand 1 is included in each of Columns A, B, and C. In certain embodiments, player hand 1 is included in one of the columns such as Column B. In certain embodiments, the gaming system makes a random determination as to which column will include player hand 1. This is done either prior to or after the player making the selection to apply the modifier. In various embodiments, the modifier is not shown to the player until the player makes the determination to apply it to a row or a column.

Figure 3:
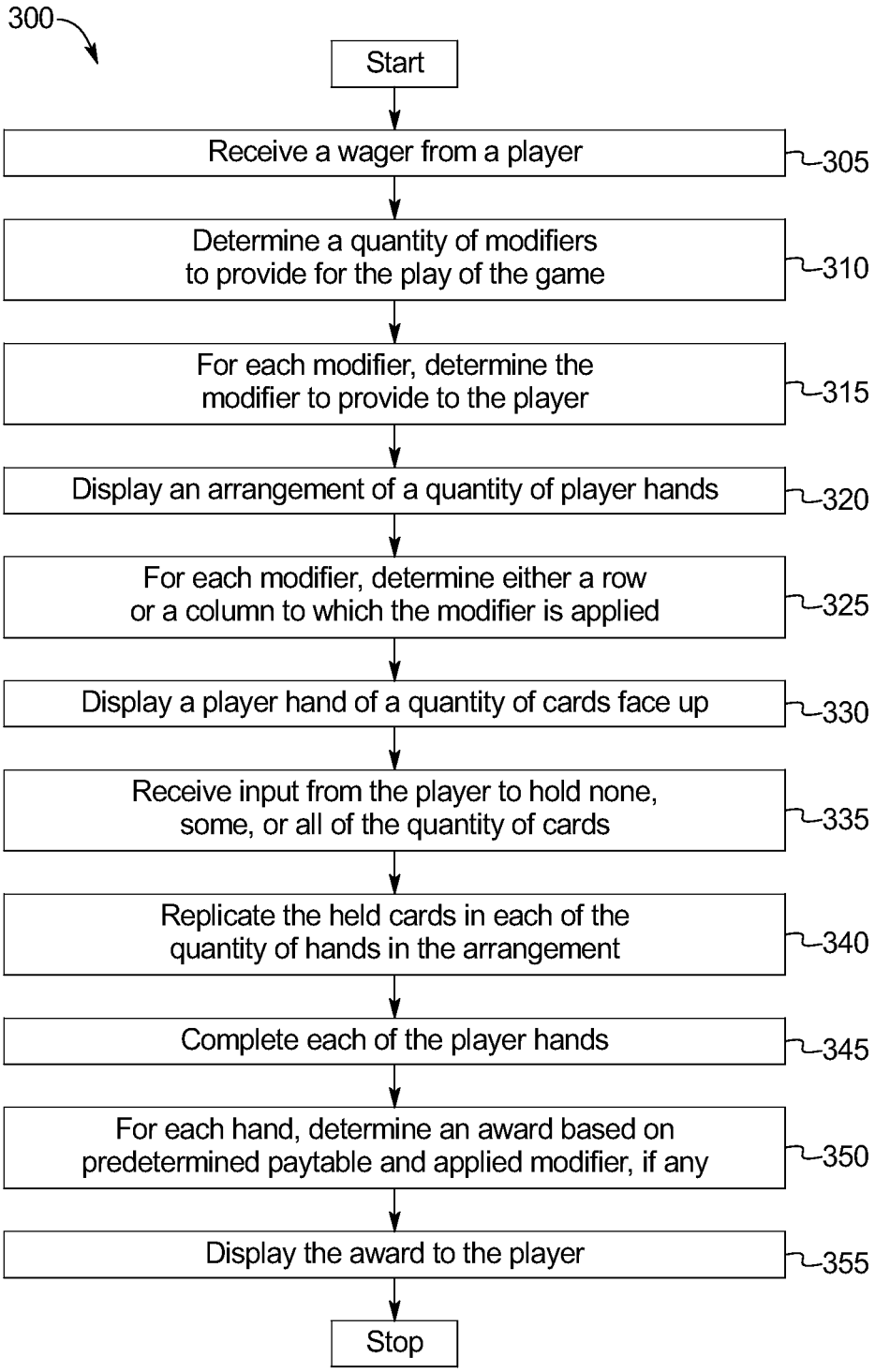
FIG. 3 is a flowchart illustrating a method of operating an example embodiment of a gaming system of the present disclosure.

FIG. 3 is a flowchart illustrating a method of operating an example embodiment of a gaming system of the present disclosure. In various embodiments, process 300 is represented by a set of instructions stored in one or more memories and executed by one or more processors. Although process 300 is described with reference to the flowchart shown in FIG. 3, it should be appreciated that many other processes of performing the acts associated with this illustrated process 300 may be employed. For example, the order of certain of the illustrated blocks and/or diamonds may be changed, certain of the illustrated blocks and/or diamonds may be optional, and/or certain of the illustrated blocks and/or diamonds may not be employed.

The gaming system is configured to begin the play of a multi-hand video poker game upon receiving a wager for the play of the game from a player, as indicated by block 305. The gaming system then determines a quantity of modifiers to provide for the play of the game, as indicated by block 310. The gaming system then determines the modifier for each of the quantity of modifiers, as indicated by block 315. For example, if the gaming system determines to provide two modifiers to the player for that play of the game, the gaming system then determines the modifier for each of the two modifiers to be provided. In various embodiments, the quantity of modifiers is predetermined, randomly determined, based on the amount of wager, or based on one or more other factors.

The gaming system displays an arrangement of a quantity of player hands including a first player hand and a second quantity of player hands to the player, as indicated by block 320. The arrangement is displayed such that the arrangement from the quantity of player hands has at least one column and one row. For example, in certain embodiments, the arrangement is shown as a grid of player hands with n rows and m columns, where m>0 and n>0. In certain embodiments, m=n. The player hands in the arrangement are empty, that is they are displayed without any playing cards.

As indicated by block 325, the gaming system then determines at least one row and/or at least one column of the arrangement to which to apply the determined one or more modifiers. After making the determination, the gaming system then displays a quantity of cards face up to the player in the first player hand from a first deck of playing cards, as indicated by block 330. In various embodiments, the quantity of cards is five. The gaming system then receives at least one input from the player, indicative of zero, some, or all of the quantity of cards provided that the player wishes to hold, as indicated by block 335. The cards that are not held by the player are discarded.

The gaming system replicates the cards that are held by the player in the first player hand to the second quantity of player hands, as indicated by block 340. The gaming system then completes the first player hand by replacing the cards that are not held, if any, with different cards selected from the first deck of playing cards, as indicated by block 345. The gaming system also completes each of the second quantity of player hands, as indicated by block 345. For each player hand in the second quantity of player hands, the gaming system provides additional playing cards, if any, from a separate deck of playing cards.

At block 350, the gaming system determines an award, if any, based on each of the player hands and the applied modifiers. The gaming system uses one or more paytables to determine an award for each hand. The gaming system then applies the provided modifier to the selected player hands in the second quantity of player hands to modify the awards for those player hands. The awards for each of the player hands are then combined to determine a total award for the player. This award is then displayed to the player, as indicated by block 355. This concludes the play of the game, and the gaming system then enables the player to place another wager, to begin another round of play.

It should be appreciated that the present disclosure contemplates different modifiers, including, but not limited to, wild cards, multipliers, feature unlocks such as a fever mode, additional credits, a modified paytable, or bonus games.

In some embodiments, the modifier is provided as a bonus round. In various embodiments, the modifier is provided as a fever mode. In the fever mode, the player is provided certain features that were not available to the player in the normal mode of play. The fever mode is usually provided for one or more plays of the game that occur after the play in which it is provided. That is, the gaming system provides a predetermined quantity of plays of the game with the feature after the completion of the current play of the game. The player may also win additional fever plays in the two plays with additional cards acting as wild or be able to extend the quantity of fever plays, thereby building the ability to stack multiple fever plays. In various embodiments where the modifier includes fever mode, the fever mode is activated when any of the hands to which the fever mode modifier is applied are winning hands, or win a certain amount or threshold value or level.

Other embodiments of the fever mode include those where a different paytable is provided for the play of the game. Preferably, the paytable is better than the paytable provided during normal play of the game. A better paytable is one that, on average, pays more to the player by increasing the payback for winning combinations, by increasing the probability of achieving one or more winning combinations, or by providing additional winning combinations.

In various embodiments, the modifier is provided as a combination of one or more of the above mentioned modifiers. For example, in certain embodiments, modifier is a combination of a wild card and a multiplier.

In various embodiments, the deck of playing cards from which player cards are randomly drawn by the gaming system includes one or more additional wild cards, such as jokers.

In various embodiments, the gaming system requires the player to place an additional wager to enable the player to win additional win opportunities. In certain of these embodiments, if the player does not make the additional wager, then the gaming system does not provide the modifier to the player.

In various embodiments, the gaming system displays replicated cards as they are held by the player. In other words, the gaming system first displays a single player hand with a quantity of playing cards and the other player hands are displayed without any cards. The gaming system then enables the player to hold zero, some or all of the cards in the quantity of playing cards. The gaming system receives input from the player indicative of the cards to be held. As the input is received by the gaming system, the gaming system replicates the cards being held, without waiting for the player to hit a redraw or deal button indicating that the player has completed the choice for the cards to be held.

In various embodiments, the gaming system provides a paytable for the first hand and a second different paytable for the other hands. In certain embodiments, each player hand may be evaluated against a different paytable.

It should be appreciated by one skilled in the art that different embodiments include different base games without deviating from the scope of this disclosure. For example, in certain embodiments, the base game is a video poker game. In other embodiments, the base game is a variation of a video poker game, such as bonus video poker.

It should be appreciated that in different embodiments, one or more of:

i. whether a modifier is provided;

ii. which modifier to provide;

iii. the quantity of modifiers to provide;

iv. the value or type of the modifiers to provide;

v. the row or column to which a modifier will be applied;

vi. the player cards to provide in any player hand;

vii. the quantity of player hands to provide;

viii. the quantity of cards in each player hand; and/or ix. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming system, determined independent of a random determination at the gaming system, determined based on at least one play of at least one game, determined independent of at least one play of at least one game, determined based on a player's selection or input, determined independent of a player's selection or input, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 4A:
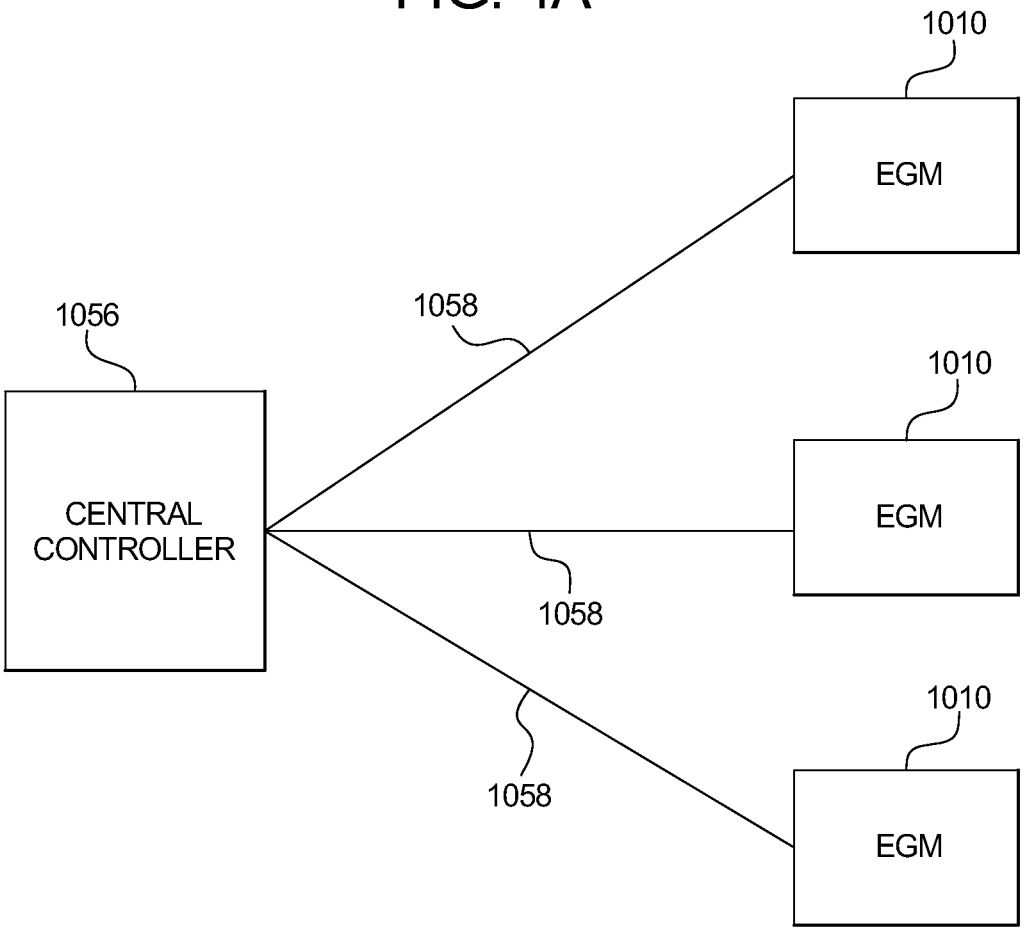
FIG. 4A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 4A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 4B:
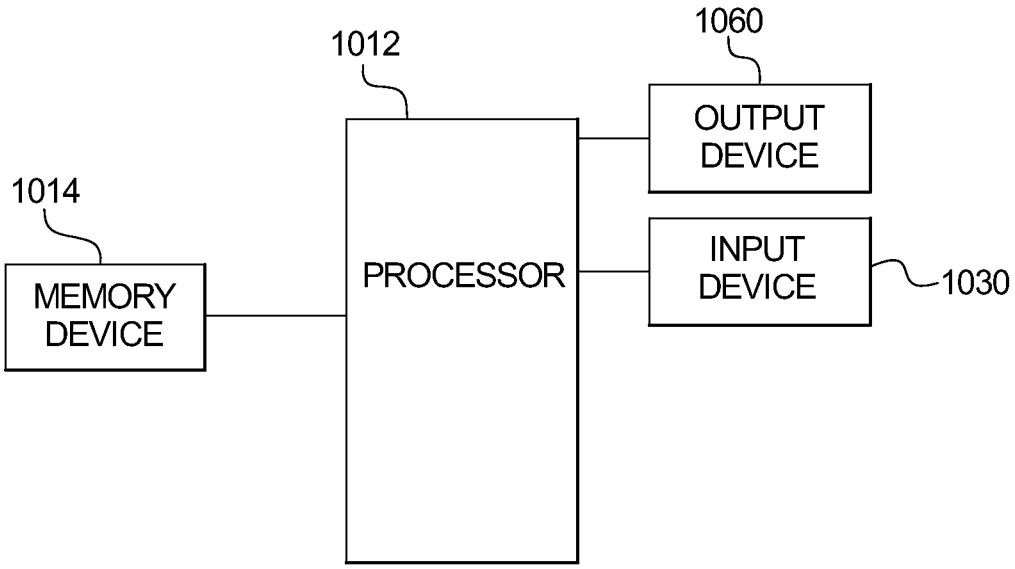
FIG. 4B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 4B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 4B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 5A:
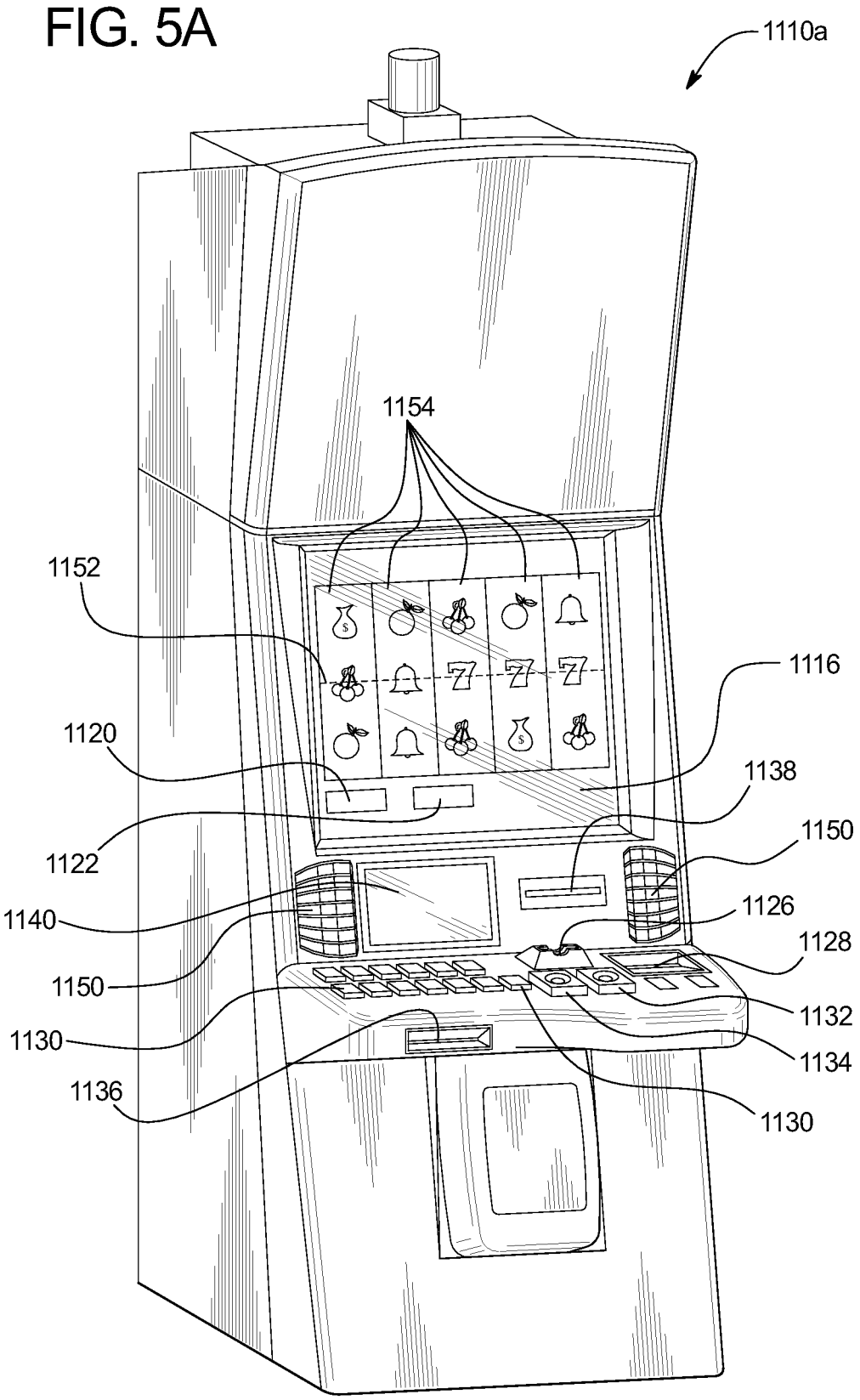
FIGS. 5A and 5B are perspective views of example alternative embodiments of the gaming system of the present disclosure.
Figure 5B:
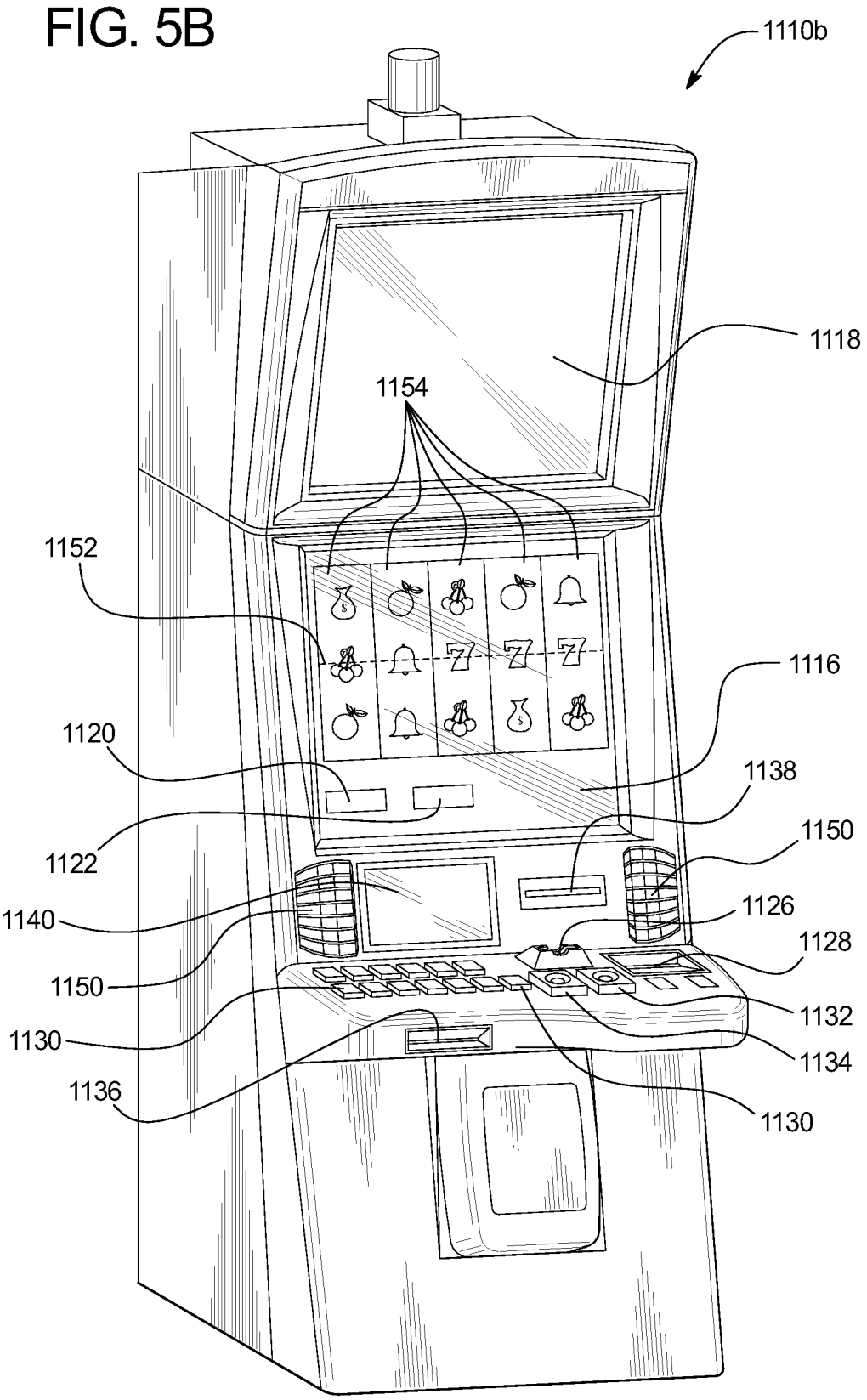

In various embodiments, the EGM includes one or more input devices. The input devices may include any suitable device that enables an input signal to be produced and received by the at least one processor of the EGM. The example EGM illustrated in FIG. 4B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 5A and 5B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 5A and 5B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 5A and 5B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 5A and 5B each include a card reader 1138. The card reader is configured to read a player identification card inserted into the card reader.

In various embodiments, the EGM includes one or more output devices. The example EGM illustrated in FIG. 4B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 5A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided for the play of the game. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 5A and 5B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 5A and 5B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 5A and 5B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 5A and 5B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome)

and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award or payout to be obtained addition to any award or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game (s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. An electronic gaming machine comprising:

a payment acceptor;

at least one processor; and at least one memory device storing a plurality of instructions that, when executed by the at least one processor, cause the at least one processor to:

responsive to a physical item being received via the payment acceptor, modify a credit balance based on a monetary value associated with the received physical item, wherein the physical item is selected from the group consisting of: a ticket associated with the monetary value and a unit of currency;

thereafter, enable placement of a wager, via at least one input device, on a single play of a game, the credit balance being decreasable based on the placed wager;

for the single play of the game:

determine one and only one multiplier in addition to the wager;

communicate data which results in at least one display device displaying a plurality of player hand display areas including a first player hand display area and a plurality of second player hand display areas arranged to form at least two rows and at least two columns;

enable one and only one selection between: (1) any one of the at least two rows, and (2) any one of the at least two columns;

responsive to one and only one of the at least two rows being selected, apply the multiplier to the selected row;

responsive to one and only one of the at least two columns being selected, apply the multiplier to the selected column;

randomly select a plurality of cards of a set of multiple cards to form a first player hand;

communicate data which results in the at least one display device displaying the cards of the first player hand at the first player hand display area;

for each of the cards of the first player hand, enable placement of a hold input via the at least one input device;

for each received hold input, designate the card of the first player hand associated with that hold input as a held card;

for each of any non-held cards of the first player hand:

randomly select a replacement card from the set of cards, and communicate data which results in the at least one display device displaying a replacement of that non-held card with the replacement card;

communicate data which results in the at least one display device displaying a second quantity of player hands at the second player hand display areas, wherein each of the second quantity of player hands includes each of any held cards of the first player hand and, if at least one of the cards of the first player hand was not held, one or more randomly determined cards;

determine an award, if any, based on the first player hand, the second quantity of player hands, and the applied multiplier, if any, wherein the credit balance is increasable based on any determined award; and responsive to a cashout input being received, cause an initiation of any payout associated with the credit balance.

2. The electronic gaming machine of claim 1, wherein when executed by the at least one processor, the plurality of instructions cause the at least one processor to select the one and only one of: (1) any one of the at least two rows, or (2) any one of the at least two columns responsive to receipt, via the at least one input device, of a player selection input that indicates the selected row or column.

3. The electronic gaming machine of claim 2, wherein when executed by the at least one processor, the plurality of instructions cause the at least one processor to communicate data which results in the at least one display device displaying a revelation of the multiplier after receipt of the player selection input.

4. The electronic gaming machine of claim 1, wherein the first player hand entirely occupies one of the at least two rows.

5. An electronic gaming machine comprising:

a payment acceptor;

at least one processor; and at least one memory device storing a plurality of instructions that, when executed by the at least one processor, cause the at least one processor to:

responsive to a physical item being received via the payment acceptor, modify a credit balance based on a monetary value associated with the received physical item, wherein the physical item is selected from the group consisting of: a ticket associated with the monetary value and a unit of currency;

thereafter, enable placement of a wager for a play of a game via at least one input device, the credit balance being decreasable based on the placed wager;

determine a quantity of multipliers in addition to the wager to include in a set of multipliers to be provided for the play of the game, the quantity of multipliers being at least one and the quantity of multipliers being less than a total quantity of player hands which any awards are determined for in the play of the game;

determine which of a plurality of multipliers to include in the set of multipliers for the play of the game;

communicate data which results in at least one display device displaying a plurality of player hand display areas including a first player hand display area and a plurality of second player hand display areas arranged to form at least two rows and at least two columns;

for each multiplier in the set of multipliers:

enable one and only one selection between: (1) any one of the at least two rows, and (2) any one of the at least two columns, responsive to one and only one of the at least two rows being selected, apply that multiplier to the selected row, and responsive to one and only one of the at least two columns being selected, apply that multiplier to the selected column;

randomly select a plurality of cards of a set of multiple cards to form the first player hand;

communicate data which results in the at least one display device displaying the cards of the first player hand at the first player hand display area;

for each of the cards of the first player hand, enable placement of a hold input via the at least one input device;

for each received hold input, designate the card of the first player hand associated with that hold input as a held card;

for each of any non-held cards of the first player hand:

randomly select a replacement card from the set of cards, and communicate data which results in the at least one display device displaying a replacement of that non-held card with the replacement card;

communicate data which results in the at least one display device displaying a second quantity of player hands at the second player hand display areas, wherein each of the second quantity of player hands includes each of any held cards of the first player hand and, if at least one of the cards of the first player hand was not held, one or more randomly determined cards;

determine an award, if any, based on the first player hand, the second quantity of player hands, and the set of applied multipliers, the credit balance being increasable based on any determined award; and responsive to a cashout input being received, cause an initiation of any payout associated with the credit balance.

6. The electronic gaming machine of claim 5, wherein when executed by the at least one processor, the plurality of instructions cause the at least one processor to, for each of the set of multipliers, select the one and only one of: (1) any one of the at least two rows, or (2) any one of the at least two columns responsive to receipt, via the at least one input device, of a player selection input that indicates the selected row or column.

7. The electronic gaming machine of claim 6, wherein when executed by the at least one processor, the plurality of instructions cause the at least one processor to communicate data which results in the at least one display device displaying, for each of the set of multipliers, a revelation of that multiplier after receipt of the player selection input.

8. The electronic gaming machine of claim 5, wherein the first player hand entirely occupies one of the at least two rows.

9. A method of operating an electronic gaming machine, said method comprising:

after increasing a credit balance via a payment acceptor of a physical item associated with a monetary value, enabling, by at least one input device, a placement of a wager on a single play of a game, wherein the credit balance is decreasable based on the placement of the wager; and for the single play of the game:

determining, by at least one processor, one and only one multiplier in addition to the wager;

causing, by the at least one processor, at least one display device to display a plurality of player hand display areas including a first player hand display area and a plurality of second player hand display areas arranged to form at least two rows and at least two columns;

enabling one and only one selection, by the at least one processor, between: (1) any one of the at least two rows, and (2) any one of the at least two columns, responsive to one and only one of the at least two rows being selected, applying, by the at least one processor, the multiplier to the selected row;

responsive to one and only one of the at least two columns being selected, applying, by the at least one processor, the multiplier to the selected column;

randomly selecting, by the at least one processor, a plurality of cards of a set of multiple cards to form a first player hand;

causing, by the at least one processor, the at least one display device to display the cards of the first player hand at the first player hand display area;

for each of the cards of the first player hand, enabling, by the at least one input device, placement of a hold input;

for each received hold input, designating, by the at least one processor, the card of the first player hand associated with that hold input as a held card;

for each of any non-held cards of the first player hand:

randomly selecting, by the at least one processor, a replacement card from the set of cards, and causing, by the at least one processor, the at least one display device to replace that non-held card with the replacement card;

causing, by the at least one processor, the at least one display device to display a second quantity of player hands at the second player hand display areas, wherein each of the second quantity of player hands includes each of any held cards of the first player hand and, if at least one of the cards of the first player hand was not held, one or more randomly determined cards; and determining, by the at least one processor, an award, if any, based on the first player hand, the second quantity of player hands, and the applied multiplier, if any, wherein the credit balance is increasable based on any determined award.

10. The method of claim 9, which includes selecting, by the at least one processor, the one and only one of: (1) any one of the at least two rows; or (2) any one of the at least two columns responsive to receipt, via the at least one input device, of a player selection input that indicates the selected row or column.

11. The method of claim 10, which includes causing, by the at least one processor, the at least one display device to reveal the multiplier after receipt of the player selection input.

12. The method of claim 9, wherein the first player hand entirely occupies one of the at least two rows.

13. A method of operating an electronic gaming machine, said method comprising:

after increasing a credit balance via a payment acceptor of a physical item associated with a monetary value, enabling, by at least one input device, placement of a wager for a play of a game, wherein the credit balance is decreasable based on the placement of the wager;

determining, by at least one processor, a quantity of multipliers to include in a set of multipliers to be provided for the play of the game, the quantity of multipliers being at least one and the quantity of multipliers being less than a total quantity of player hands which any awards are determined for in the play of the game;

determining, by the at least one processor, which of a plurality of multipliers in addition to the wager to include in the set of multipliers for the play of the game;

causing, by the at least one processor, at least one display device to display a plurality of player hand display areas including a first player hand display area and a plurality of second player hand display areas arranged to form at least two rows and at least two columns;

for each multiplier in the set of multipliers:

enabling one and only one selection, by the at least one processor, between: (1) any one of the at least two rows, and (2) any one of the at least two columns, responsive to one and only one of the at least two rows being selected, applying, by the at least one processor, that multiplier to the selected row, and responsive to one and only one of the at least two columns being selected, applying, by the at least one processor, that multiplier to the selected column;

randomly selecting, by the at least one processor, a plurality of cards of a set of multiple cards to form the first player hand;

causing, by the at least one processor, the at least one display device to display the cards of the first player hand at the first player hand display area;

for each of the cards of the first player hand, enabling, by the at least one input device, placement of a hold input;

for each received hold input, designating, by the at least one processor, the card of the first player hand associated with that hold input as a held card;

for each of any non-held cards of the first player hand:

randomly selecting, by the at least one processor, a replacement card from the set of cards, and causing, by the at least one processor, the at least one display device to replace that non-held card with the replacement card;

causing, by the at least one processor, the at least one display device to display a second quantity of player hands at the second player hand display areas, wherein each of the second quantity of player hands includes each of any held cards of the first player hand and, if at least one of the cards of the first player hand was not held, one or more randomly determined cards; and determining, by the at least one processor, an award, if any, based on the first player hand, the second quantity of player hands, and the set of applied multipliers, the credit balance being increasable based on any determined award.

14. The method of claim 13, which includes selecting, by the at least one processor, for each of the set of multipliers, the one and only one of: (1) any one of the at least two rows; or (2) any one of the at least two columns responsive to receipt, via the at least one input device, of a player selection input that indicates the selected row or column.

15. The method of claim 14, which includes, for each of the set of multipliers, causing, by the at least one processor, the at least one display device to reveal the multiplier after receipt of the at least one player selection input.

16. The method of claim 13, wherein the first player hand entirely occupies one of the at least two rows.

* * * * *